US007084560B2

(12) United States Patent
Ha et al.

(10) Patent No.: US 7,084,560 B2
(45) Date of Patent: Aug. 1, 2006

(54) TENSION MASK FRAME ASSEMBLY AND CATHODE RAY TUBE HAVING THE SAME

(75) Inventors: Kuen-Dong Ha, Seongnam (KR); Joon-Seong Park, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 178 days.

(21) Appl. No.: 10/419,948

(22) Filed: Apr. 22, 2003

(65) Prior Publication Data

US 2003/0201706 A1 Oct. 30, 2003

(30) Foreign Application Priority Data

Apr. 24, 2002 (KR) ..... 2002-0022458

(51) Int. Cl.
*H01J 29/80* (2006.01)

(52) U.S. Cl. ..... 313/404; 313/405; 313/407

(58) Field of Classification Search ..... 313/402–407
See application file for complete search history.

(56) References Cited

U.S. PATENT DOCUMENTS 4,885,501 A * 12/1989 Tong ..... 313/402
6,046,534 A * 4/2000 Horiuchi ..... 313/402
6,069,437 A * 5/2000 Matsuki et al. ..... 313/407
6,388,369 B1 * 5/2002 Lee ..... 313/403
2002/0027404 A1 * 3/2002 Itou ..... 313/404
2002/0135286 A1 9/2002 Ha et al.
2003/0117057 A1 6/2003 In et al.

FOREIGN PATENT DOCUMENTS

JP 08-124489 5/1996
KR 2001-1878 1/2001
KR 2001-65365 10/2001

* cited by examiner

*Primary Examiner*—Ashok Patel
*Assistant Examiner*—Anthony Canning
(74) *Attorney, Agent, or Firm*—Robert E. Bushnell, Esq.

(57) ABSTRACT

A tension mask frame assembly for a color cathode ray tube (CRT) includes a frame and a tension mask installed to apply tension to the support members, and wherein a plurality of electron beam passing holes are formed. The frame includes; a pair of first and second support members separated by a predetermined distance; first and second elastic members installed between the first and second support members, and supporting the first and second support members; and first, second, third, and fourth holder units installed on the first and second support members and the first and second elastic members, and respectively including first, second, third, and fourth holders and first, second, third, and fourth springs fixed to the first, second, third, and fourth holders. The thermal expansion coefficient of the material forming the third and fourth holders is no more than that of the material forming the first and second elastic members.

24 Claims, 7 Drawing Sheets

TENSION MASK FRAME ASSEMBLY AND CATHODE RAY TUBE HAVING THE SAME

CLAIM OF PRIORITY

This application makes reference to, incorporates the same herein, and claims all benefits accruing under 35 U.S.C §119 from my application FRAME FOR THE TENSION MASK-FRAME ASSEMBLY AND CATHODE RAY TUBE HAVING THE SAME filed with the Korean Industrial Property Office on Apr. 24, 2002 and there duly assigned Serial No. 22458/2002.

BACKGROUND OF THE INVENTION

1. Technical Field

The present invention relates to a color cathode ray tube (CRT), and more particularly to a tension mask frame assembly having an improved thermal compensation feature compensating for a mislanding of an electron beam.

2. Related Art

In a color cathode ray tube, three electron beams are emitted from an electron gun and land on fluorescent substances for red, green and blue colors coated on a fluorescent film formed on a screen surface of a panel via passing electron beam passing holes of a mask having a color selection function. The electron beams excite the fluorescent substances to form an image.

In the above color cathode ray tube forming an image, masks having a color selection function are classified as a dot mask adopted in a computer monitor or as a slot mask (or slit mask) used in a television.

A tension mask which is one of the slot masks, is supported by a frame to apply tension considering a screen surface which is flat so as to compensate for distortion of an image and to widen a viewing angle of a screen, and a lot of developments have been performed. A mask frame assembly, which supports a frame and a mask so that tension is applied by the frame, is installed in a panel of a color cathode ray tube.

A color cathode ray tube includes a panel having a screen surface that is flat and wherein a fluorescent film is formed, a tension mask frame assembly suspended on an inner surface of the panel, a funnel coupled to the panel forming a seal, where an electron gun is sealed in a neck portion, and a deflection yoke installed at a cone portion of the funnel.

A tension mask frame assembly includes a tension mask wherein a plurality of long slots are formed, support members for supporting corresponding edges of the tension mask, and elastic members for applying tension to the tension mask by supporting the respective end portions of the support members.

The tension mask frame assembly having the above structure attempts to compensate for mislanding of electron beams due to thermal expansion as it is heated by the electron beams that do not pass through the slots which are electron beam passing holes.

Exemplars of recent efforts in the art are disclosed, for example, in Japanese Publication Number 08-124489 to Imada et al., entitled COLOR SORTING DEVICE, published on May 17, 1996, Korean Patent Application No. 2001-1878 to Ha et al., entitled MASK-FRAME ASSEMBLY FOR COLOR CATHODE-RAY TUBE, filed on Jan. 12, 2001, U.S. patent application Ser. No.09/938,838 (Publication No. US-2002-0135286-A1) to Ha et al., entitled MASK-FRAME ASSEMBLY FOR COLOR CATHODE-RAY TUBE, published on Sep. 26, 2002, Korean Patent Application No. 2001-65365 entitled MASK FRAME ASSEMBLY AND COLOR CRT USING THE SAME, filed on Oct. 23, 2001, and U.S. patent application Ser. No. 10/269,075 entitled MASK FRAME ASSEMBLY AND COLOR CRT USING THE SAME. A structure of a panel of a tension mask frame assembly is disclosed in the Japanese Publication No. hei 8-124489.

While these contemporary efforts contain merit, it is our observation that further improvements can also be contemplated to more sufficiently compensate for movement due to thermal expansion and to achieve more improvements, including better color purity.

SUMMARY OF THE INVENTION

To solve the above-described problems, the present invention provides a tension mask frame assembly which can improve a thermal compensation feature due to thermal expansion by the electron beam emitted from the electron gun, and the structure of which is simple so that production cost is reduced, and a color cathode ray tube using the same.

The present invention provides a tension mask frame assembly in which the thermal deformation force of the electron beam at low and high temperatures can be easily compensated.

The present invention provides a tension mask frame assembly for a color cathode ray tubes, comprising a frame which includes a pair of first and second support members separated by a predetermined distance, first and second elastic members installed between the first and second support members and supporting the first and second support members, and first, second, third, and fourth holder units installed at the first and second support members and the first and second elastic members, and respectively including first, second, third, and fourth holders and first, second, third, and fourth springs fixed to the first, second, third, and fourth holders, and a tension mask installed so as to apply tension to the support member, and wherein a plurality of electron beam passing holes are formed. A thermal expansion coefficient of a material forming the third and fourth holders is no more than that of a material forming the first and second elastic members.

In the present invention, each of the first through fourth holder units has a structure including a holder fixed to the first and second support members or the first and second elastic members, and a spring coupled to the holder, and wherein a through hole into which a stud pin is coupled is formed. A thermal expansion coefficient of a material forming the first and second holder units can be greater than that of a material forming the first and second elastic members.

In accordance with the principles of the present invention, as embodied and broadly described, the present invention provides a tension mask frame assembly for a color cathode ray tube, the assembly comprising a frame, which includes: first and second support members separated by a predetermined distance, first and second elastic members installed between said first and second support members, supporting said first and second support members, said elastic members including a first material having a first thermal expansion coefficient; first and second securing units, said first securing unit being installed at said first support member and including a first holder and a first spring fixed to said first holder, said second securing unit being installed at said second support member and including a second holder and a second spring fixed to said second holder; and third and fourth securing units, said third securing unit being installed at said first elastic member and including a third holder and a third spring fixed to said third holder, said fourth securing unit being installed at said second elastic member and including a fourth holder and a fourth spring fixed to said fourth holder, said third and fourth holders including a second material having a second thermal expansion coefficient, with the second thermal expansion coefficient being selected from a coefficient that is less than the first thermal expansion coefficient and a coefficient that is equal to the first thermal expansion coefficient; and a tension mask installed to apply tension to said support members, said tension mask forming a plurality of electron beam passing holes.

In accordance with the principles of the present invention, as embodied and broadly described, the present invention provides a tension mask apparatus, comprising: first and second support members; an elastic member installed between said first and second support members and supporting said first and second support members, said elastic member including a first material having a first thermal expansion coefficient; a first securing unit installed on said elastic member, said first securing unit including a first holder and a first spring fixed to said first holder, said first holder including a second material having a second thermal expansion coefficient, with the second thermal expansion coefficient being selected from a coefficient that is less than the first thermal expansion coefficient and a coefficient that is equal to the first thermal expansion coefficient; and a tension mask installed so as to apply tension to said support members, said tension mask forming a plurality of electron beam passing holes.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DESCRIPTION OF BEST MODE OF CARRYING OUT THE INVENTION

While the present invention will be described more fully hereinafter with reference to the accompanying drawings, in which details of the present invention are shown, it is to be understood at the outset of the description which follows that persons of skill in the appropriate arts may modify the invention here described while still achieving the favorable results of this invention. Accordingly, the description of the best mode contemplated of carrying out the invention, which follows, is to be understood as being a broad, teaching disclosure directed to persons of skill in the appropriate arts, and not as limiting upon the present invention.

Illustrative embodiments of the best mode of carrying out the invention are described below. In the interest of clarity, not all features of an actual implementation are described. In the following description, well-known functions, constructions, and configurations are not described in detail since they could obscure the invention with unnecessary detail. It will be appreciated that, in the development of any actual embodiments numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 1:
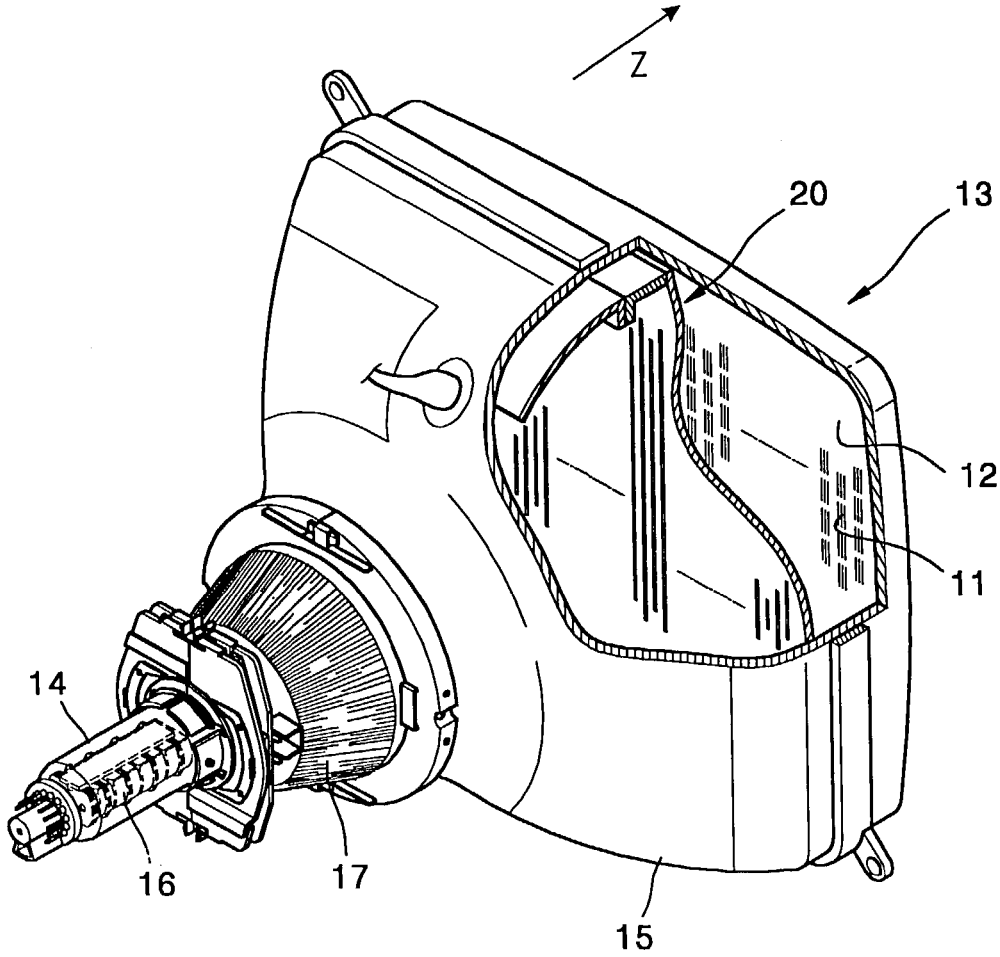
FIG. 1 is a partially cut-away perspective view of a color cathode ray tube.

A mask frame assembly which support a frame and a mask so that tension is applied by the frame is installed in a panel of a color cathode ray tube. FIG. 1 shows an example of the color cathode ray tube. FIG. 1 is a partially cut-away perspective view of a color cathode ray tube.

Referring to FIG. 1, a color cathode ray tube includes a panel 13 having a screen surface 12 that is flat and wherein a fluorescent film 11 is formed, a tension mask frame assembly 20 suspended on an inner surface of the panel 13, a funnel 15 coupled to the panel 13 and forming a seal, wherein an electron gun 16 is sealed in a neck portion 14, and a deflection yoke 17 installed in a cone portion of the funnel 15.

Figure 2:
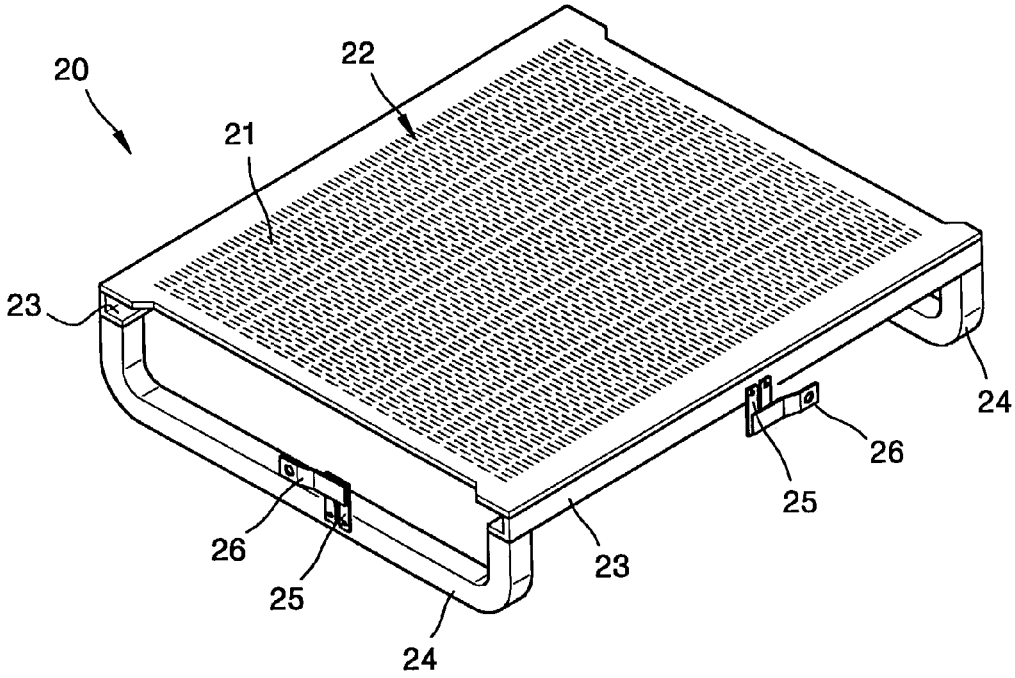
FIG. 2 is a perspective view of a mask frame assembly.

FIG. 2 is a perspective view of a mask frame assembly. The tension mask frame assembly 20, as shown in FIG. 2, includes a tension mask 22 wherein a plurality of long slots 21 are formed, support members 23 for supporting corresponding edges of the tension mask 22, and elastic members 24 for applying tension to the tension mask 22 by supporting the respective end portions of the support members 23.

The mask frame assembly 20 is suspended inside the panel 13 by a spring supporter 25 and a hook 26 supported by the spring supporter 25 and coupled to a stud pin (not shown) installed at an inner surface of the panel 13.

The tension mask frame assembly 20 having the above structure compensates for mislanding of electron beams due to thermal expansion as it is heated by the electron beams that do not pass through the slots 21, which are electron beam passing holes, when the spring supporter 25 formed of a bimetal is deformed so as to move the tension mask assembly 20 toward the panel 13.

Figure 3:
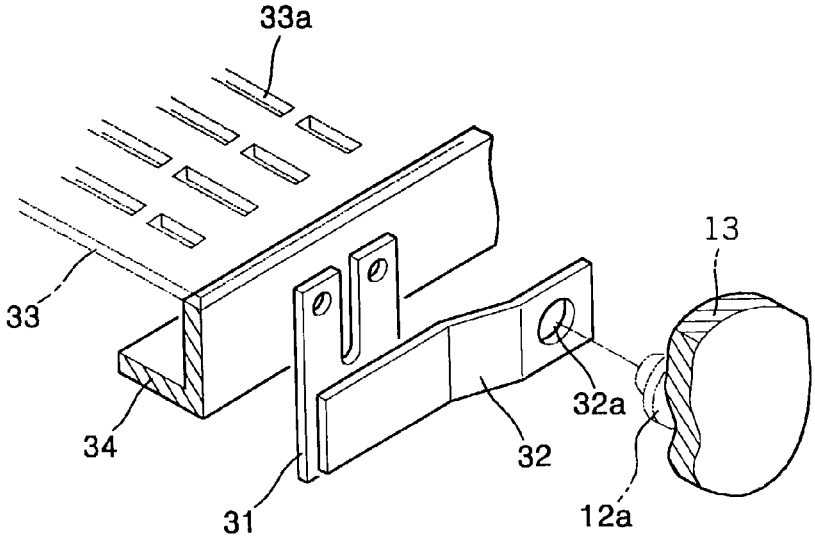
FIG. 3 is a partially cut-away, enlarged perspective view of a mask frame assembly.

FIG. 3 is a partially cut-away, enlarged perspective view of a mask frame assembly. Referring to FIG. 3, a spring supporter 31 formed of a bimetal is fixed at an outer surface of the frame, and a spring 32, having a coupling hole 32*a* to which a stud pin 12*a*, installed in an inner surface of the panel 13, is coupled, is fixed to an end portion of the spring support 31. The spring 32 is formed of a single material.

In the color cathode ray tube which includes a fixed structure of the above tension mask frame assembly, a fluorescent substance is excited as the electron beams emitted from the electron gun 16 (FIG. 1) land on the fluorescent film 11 after they are deflected by the deflection yoke 17 and pass through the electron beam passing holes 33*a* (FIG. 3) of the tension mask 33. In this process, part of the electron beams emitted from the electron gun passes through slots that are electron beam passing holes 33*a* of the tension mask 33. Approximately 15% of the beams pass through the slots. The portion of the electron beam which does not pass through the electron beam passing holes 33*a* collides against the tension mask 33 so as to heat it. Thus, the tension mask 33 and the frame 34 supporting the tension mask 33 are heated by the electron beam, that is, thermions, and are thermally expanded.

The thermal expansion of the tension mask 33, and the frame 34 entails movement of the electron beam passing holes 33*a* of the tension mask 33 causing the electron beams to undesirably misland on the fluorescent film 11 (FIG. 1). The heating due to the electron beam causes the spring supporter 31 (FIG. 3) formed of a bimetal to be thermally deformed, and causes the tension mask frame assembly 20 (FIG. 1) to move toward the panel 13. Accordingly, the electron beam passing holes 33*a* (FIG. 3) moved due to the thermal deformation of the tension mask 33 are placed on the paths of the electron beams so that the thermal expansion of the tension mask frame assembly 20 (FIG. 1) is compensated.

However, as the spring supporter 31 (FIG. 3) thermally expands, the tension mask frame assembly 20 (FIG. 1) rotates so that excess compensation occurs in the external environment at a low or high temperature. The rotating component of the tension mask frame assembly 20 and the movement of the frame assembly in the cold/hot environment generate mislanding of the electron beam so that the quality of an image is deteriorated. Also, since the spring supporter 31 is formed of a bimetal, manufacture cost increases.

Figure 4:
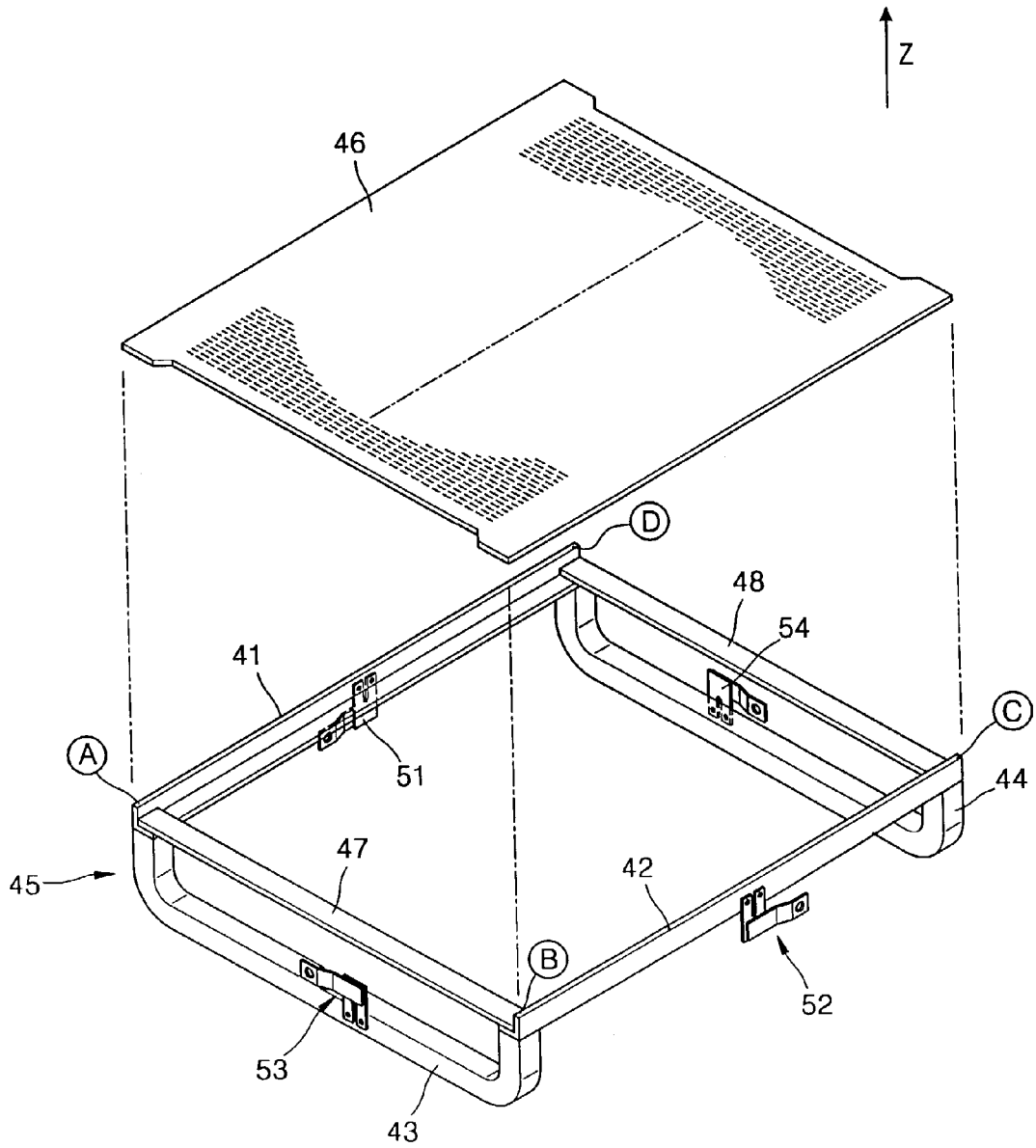
FIG. 4 is a partially cut-away perspective view of a mask frame assembly.

FIG. 4 is a partially cut-away perspective view of a mask frame assembly. Referring to FIG. 4, a tension mask frame assembly comprises a frame 45 which includes a pair of first and second support members 41 and 42 separated by a predetermined distance from each other, and first and second elastic members 43 and 44 installed between the first and second support members 41 and 42 and supporting the first and second support members 41 and 42 so that they are separated by a predetermined distance, and a tension mask 46 installed so as to apply tension to the support members 41 and 42 and wherein a plurality of electron beam passing holes are formed. Also, the tension mask frame assembly includes bars 47 and 48 installed between the first and second support members 41 and 42 so as to compensate for mislanding of electron beams due to thermal deformation of the tension mask 46 and the frame 45 by changing curvature in a direction along the axis of a cathode ray tube of the first and second support members 41 and 42 and the tension mask 46 by a difference equal to the amount of thermal expansion of the first and second elastic members 43 and 44 and the first and second support members 41 and 42. First and second hook members 51 and 52 extending downward are installed on the support members 41 and 42, respectively, and third and fourth hook members 53 and 54 extending upward are installed on the first and second elastic members 43 and 44, respectively. The first through fourth hook members 51 through 54 are coupled to stud pins installed on an inner surface of the panel 13 (FIG. 1) so that the tension mask frame assembly 20 is suspended on the inner surface of the panel 13.

In the tension mask frame assembly having the above structure, during driving, the tension mask 46 (FIG. 4) and the frame 45 thermally expand so that the mislanding of the electron beam is compensated by a change in the curvature of the tension mask 45 and the first and second support members 41 and 42 due to a difference in the amount of thermal expansion of the bars 47 and 48 and the first and second support members 41 and 42.

However, in the tension mask frame assembly, since the first and second hook members 51 and 52 extend downward so that free ends thereof are respectively disposed under the first and second support members 41 and 42, and since the third and fourth hook members 53 and 54 extend upward so that free ends thereof are respectively disposed above the first and second elastic members 43 and 44, during thermal expansion, the directions along which the first and second hook members 51 and 52 and the third and fourth hook members 53 and 54 thermally expand respectively are opposite. Thus, the first and second support members 41 and 42 move toward the panel 13 (FIG. 1) (the+direction of the z axis that is the axis direction of a cathode ray tube) and act to compensate for the mislanding due to the thermal expansion amount. However, the first and second elastic members 43 and 44 act by the third and fourth hook members 53 and 54 in a direction separated from the panel 13 (the−direction of the z axis that is the axis direction of a cathode ray tube) so that the end portions of the first and second support members 41 and 42 are prevented from moving toward the panel 13. As a result, the amount of movement according to the thermal expansion of the electron beam passing holes at the corner portion of the tension mask supported by the frame is not sufficiently compensated, and color purity is deteriorated.

Figure 5:
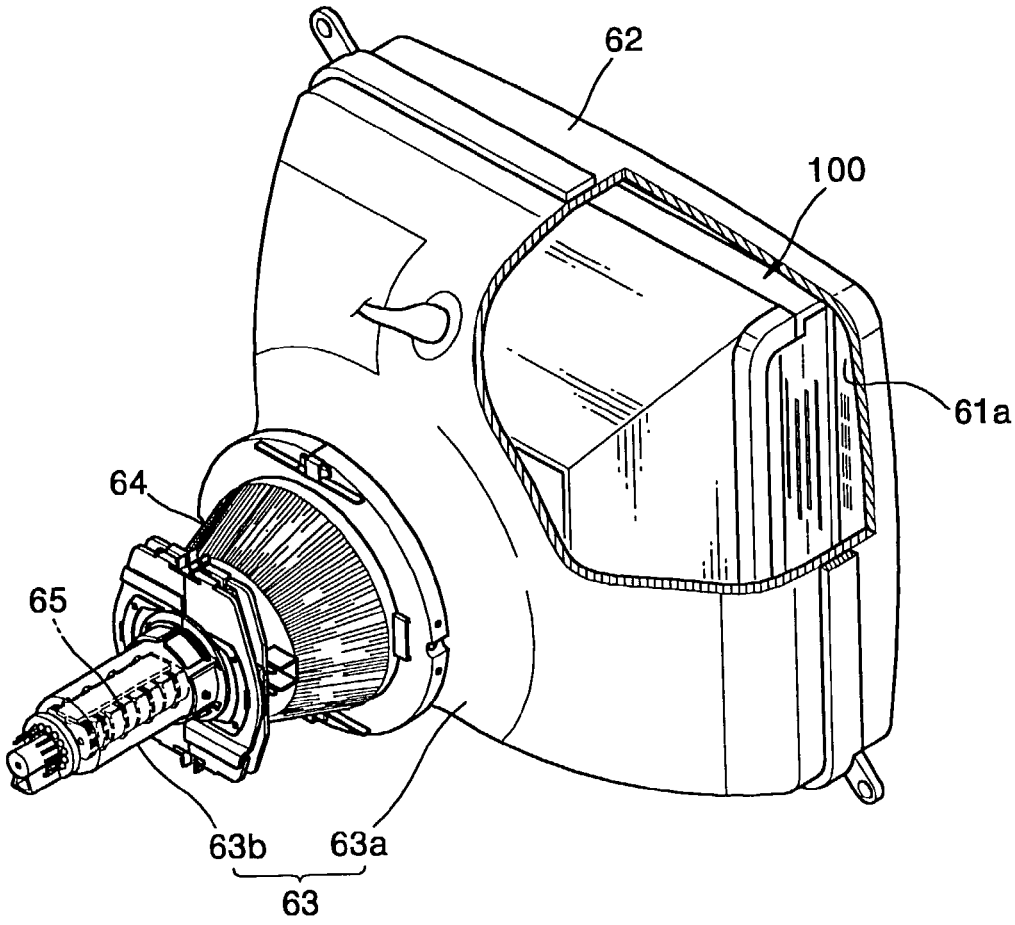
FIG. 5 is a partially cut-away perspective view of a color cathode ray tube, in accordance with the principles of the present invention.

FIG. 5 is a partially cut-away perspective view of a color cathode ray tube, in accordance with the principles of the present invention. As shown in FIG. 5, the cathode ray tube includes a panel 62 having a flat screen wherein a fluorescent film 61*a* is formed, a funnel 63 sealed with the panel 62 and having a cone portion 63*a* and a neck portion 63*b*, a deflection yoke 64 installed over the cone portion 63*a* and the neck portion 63*b* of the funnel 63, and an electron gun 65 sealed in the neck portion 63*b*. A tension mask frame assembly 100 having a color selection function of an electron beam emitted from the electron gun 65 is installed on an inner surface of the panel 62.

Figure 6:
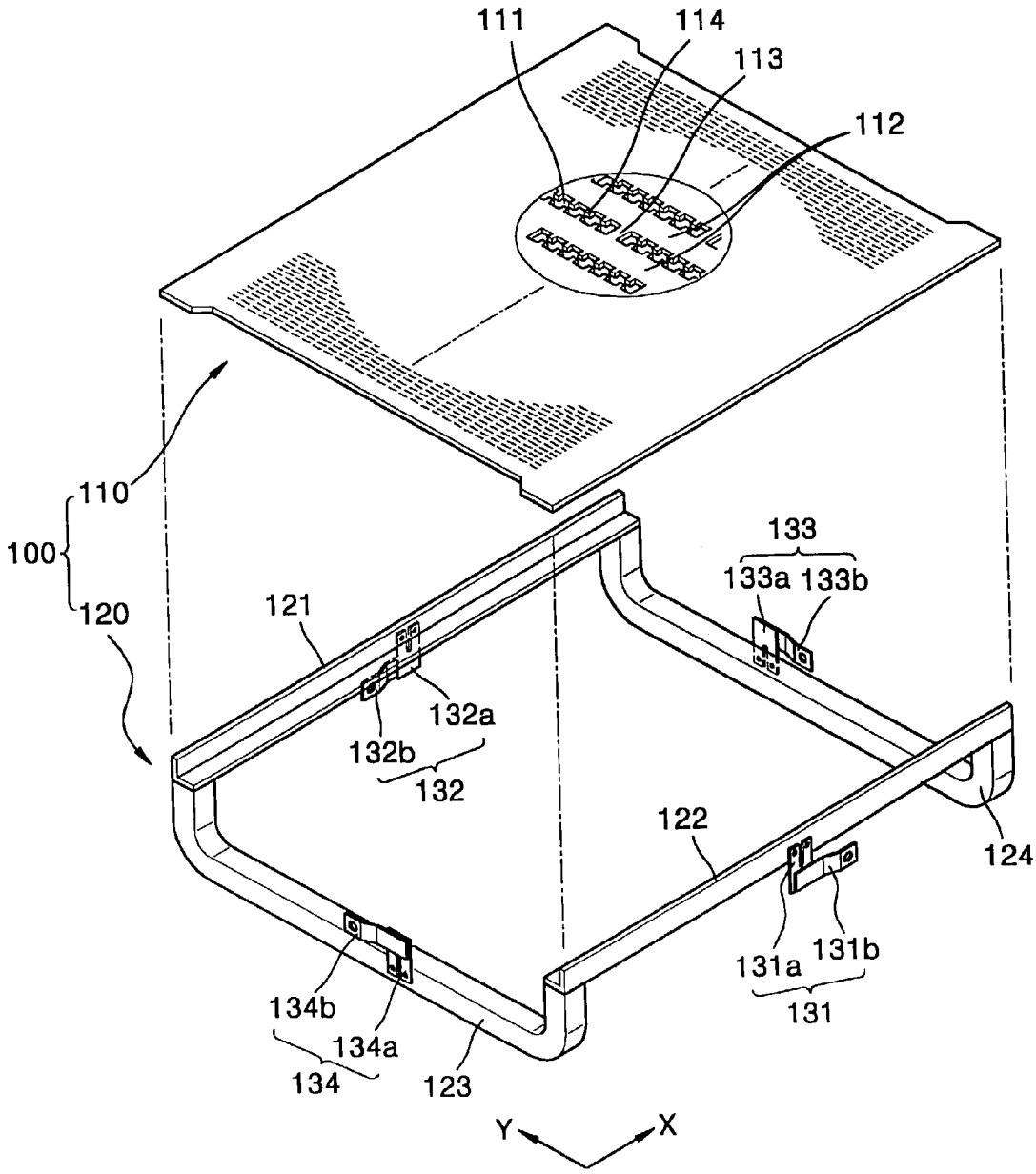
FIG. 6 is an exploded perspective view of a first embodiment of the mask frame assembly shown in FIG. 5, in accordance with the principles of the present invention.

FIG. 6 is an exploded perspective view of a first embodiment of the mask frame assembly shown in FIG. 5, in accordance with the principles of the present invention. The tension mask frame assembly 100, as shown in FIG. 6, includes a tension mask 110 having a plurality of slots extending in a Y direction (a tension direction) and a frame 120 applying tension to the tension mask 110 by supporting long side portions arranged to extend in an X direction that is the longer side of the tension mask 110.

The tension mask 110 includes a plurality of strips 112 separated by a predetermined distance and forming slits 111 in a thin plate and a real bridge 113 connecting the strips 112, that are neighboring, to section the slits 111. A dummy bridge 114 with protruding portions extending in the opposite directions from each of the neighboring strips 112 to section the slits 111 may further be formed. The tension mask 110 is not limited to the above-described preferred embodiment, and any structure of a tension mask which can apply tension is available.

The frame 120 for supporting both corresponding edges of the tension mask 110 includes a pair of first and second support members 121 and 122 separated by a predetermined distance from each other, and first and second elastic members 123 and 124 for supporting the first and second support members 121 and 122 so that tension is applied to the tension mask 110 supported by the first and second support members 121 and 122. First and second holder units 131 and 132 are installed on the first and second support members 121 and 122, respectively. The first and second holder units 131 and 132 include first and second holders 131*a* and 132*a* extending downward from the first and second support members 121 and 122, and first and second springs 131*b* and 132*b* installed at end portions of the first and second holders 131*a* and 132*a*, respectively, each having a through-hole coupled to a stud pin (not shown) installed on an inner surface of the panel 62 (FIG. 5). Third and fourth holder units 133 and 134 (FIG. 6) include third and fourth holders 133*a* and 134*a* installed on the first and second elastic members 123 and 124, respectively, so as to extend upward therefrom, and third and fourth springs 133*b* and 134*b* coupled to stud pins (not shown) of the panel 62. End portions of the third and fourth holders 133*a* and 134*a*, respectively, are installed on the first and second elastic members 123 and 124, respectively. The holder units 131, 132, 133, and 134 can be referred to as securing units 131, 132, 133, and 134, respectively.

The thermal expansion coefficient of the material forming the third and fourth holder units 133 and 134 is less than or equal to that of a material forming the first and second support members 121 and 122. Preferably, the thermal expansion coefficient of the third and fourth holder units 133 and 134 installed on the first and second elastic members 123 and 124 is less than that of the first and second holder units 131 and 132. Also, the thermal expansion coefficient of the third and fourth holder units 133 and 134 is preferably less than that of the first and second elastic members 123 and 124.

The material of the first and second holder units 131 and 132, that is, the material of the first and second holders 131*a* and 132*a*, is preferablv SUS 304H (KS standard) and the first and second support members 121 and 122 are preferably formed of SCM 415. The material of the third and fourth holder units 133 and 134, that is, the material of the third and fourth holders 133*a* and 134*a*, is preferably IN VAR or KOVAR, where INVAR preferably is comprised of 36% through 42% nickel. INVAR is a nickel-iron alloy. KOVAR is a nickel-iron-cobalt alloy. SCM is thermally refined steel. SUS is an austenitic stainless steel.

Figure 7:
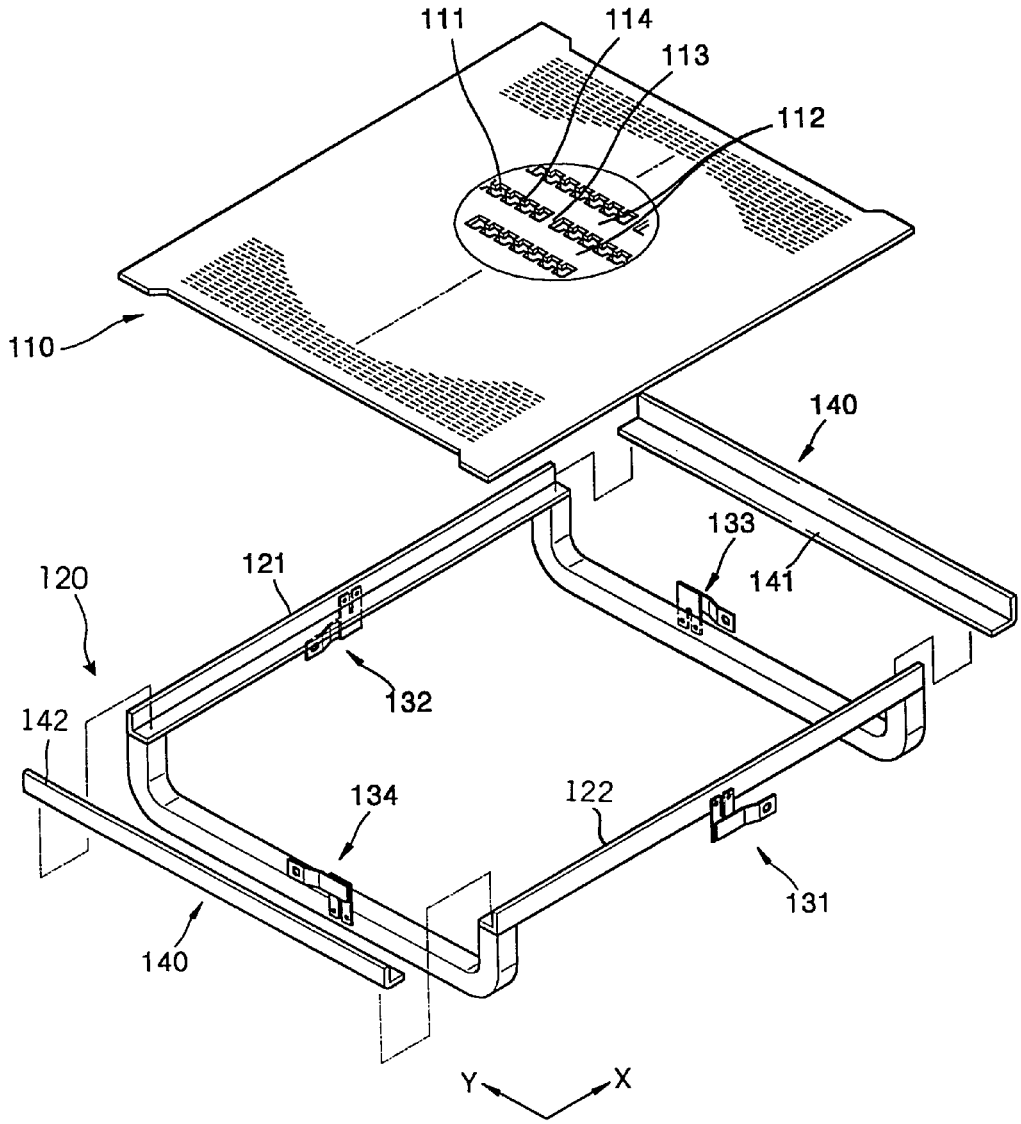
FIG. 7 is a perspective view illustrating a second embodiment of a mask frame assembly, in accordance with the principles of the present invention.

FIG. 7 is a perspective view illustrating a second embodiment of a mask frame assembly, in accordance with the principles of the present invention. Here, the same reference numerals as those in the above preferred embodiment denote the same elements.

Referring to FIG. 7, a compensation unit 140 is installed at end portions of the first and second support members 121 and 122. The compensation unit 140 is provided for the purpose of preventing plastic deformation of the tension mask 110 during a thermal process of the tension mask 110 by correcting the mislanding of the electron beam due to the thermal deformation of the tension mask 110 and the frame 120. The compensation unit 140 is formed of bars 141 and 142 connecting the end portions of the first and second support members 121 and 122. Preferably, an angle bar that is not limited in its profile is used as the bars 141 and 142. The bars 141 and 142 are formed of an INVAR member. In the frame 120 the first, second, third, and fourth holder units 131 through 134 are installed on the first and second support members 121 and 122 and the first and second elastic members 123 and 124. Since the structure, the material, and the amount of the thermal expansion coefficient according to the material are the same as those described in the above-described preferred embodiment, descriptions hereof will be omitted at this time.

The operation of a color cathode ray tube adopting the tension mask frame assembly 100 having the above structures according to the present invention will now be described below. In the tension mask frame 120, since the first through fourth holder units 131–134 are coupled to stud pins (not shown), when the color cathode ray tube in which the tension mask frame assembly 100 is suspended on the inner surface of the panel 62 (FIG. 5) is driven, a part of the electron beams emitted from the electron gun 65, that is, a part of the thermions, does not pass through the slots 111 (FIGS. 6 and 7) that are the electron beam passing holes of the tension mask 110, and heats the tension mask 110 so that the heated tension mask 110 thermally expands. This thermal expansion amount initially moves the slots 110 of the tension mask 110 so that mislanding of the electron beams is caused.

As the frame 120 thermally expands, the first and second support members 121 and 122, which are the constituent elements of the frame 120, are flattened. Since free ends of the first and second holder units 131 and 132 are disposed under the first and second support members 121 and 122, the amount of thermal expansion of the first and second holder units 131 and 132, that is, the first and second holders 131*a* and 132*a*, moves the first and second support members 121 and 122 toward the fluorescent film 61*a* (FIG. 5). Since the third and fourth holders 133*a* and 134*a* (FIGS. 6 and 7) of the third and fourth holder units 133 and 134 are formed of a material having a thermal expansion coefficient less than that of the first and second holders 131*a* and 132*a*, the restriction of both of the end portions of the first and second support members 121 and 122, supported by the first and second elastic members 123 and 124, moving toward the fluorescent film is prevented. Thus, the support members 121 and 122 are more freely permitted to move toward the fluorescent film, in accordance with the principles of the present invention.

Figure 8:
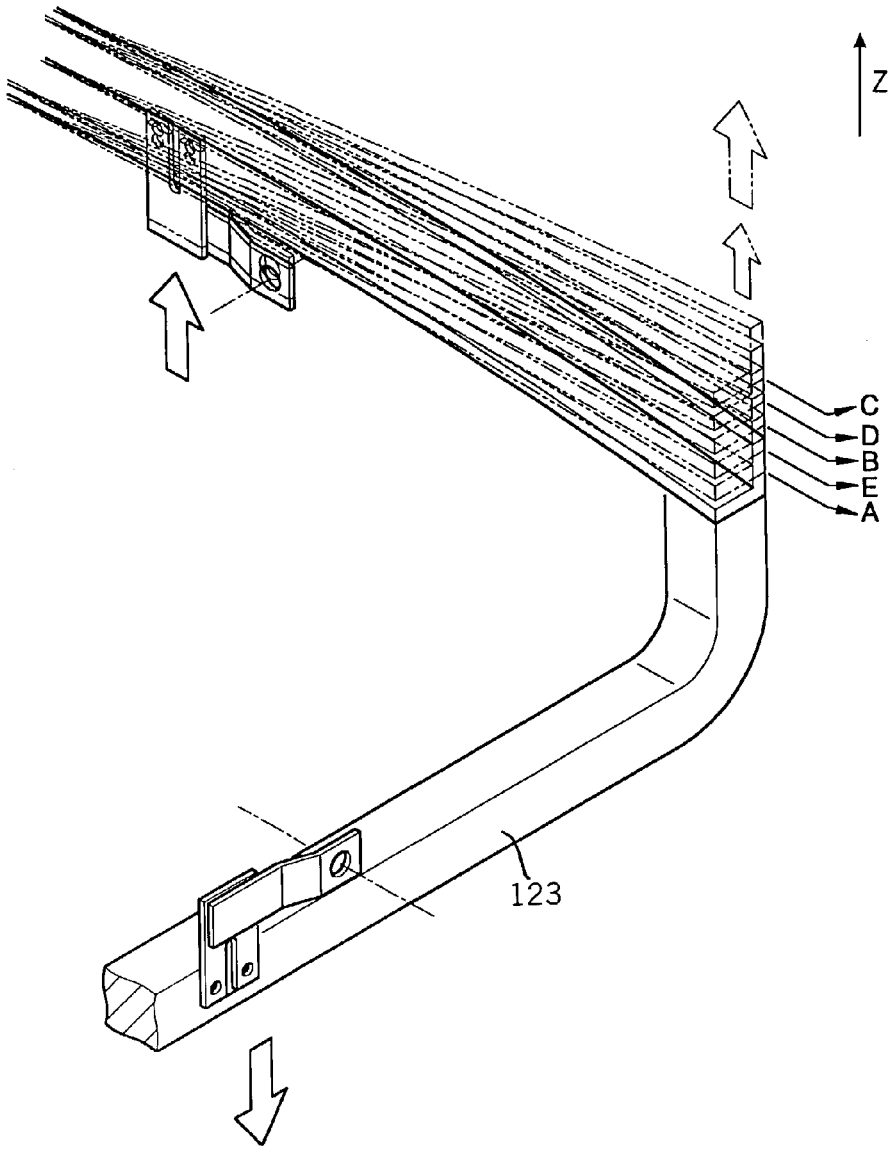
FIG. 8 is a partially cut-away perspective view showing the operation of a mask frame assembly, in accordance with the principles of the present invention.

The above operation is described below in detailed with reference to FIG. 8. FIG. 8 is a partially cut-away perspective view showing the operation of a mask frame assembly, in accordance with the principles of the present invention. Referring to FIG. 8, in the state in which the tension mask frame assembly 110 (FIGS. 6 and 7) does not thermally expand (at a position A of FIG. 8), the tension mask frame assembly 110 (FIGS. 6 and 7) thermally expands, and thus the first and second support members 121 and 122 are flattened. As the first and second holder units 131 and 132 thermally expand, the first and second support members 121 and 122 are moved in direction Z (FIG. 8) toward the fluorescent film 61*a* (FIG. 5) of the panel 62 (to a position B of FIG. 8). Here, the direction in which the first and second elastic members 123 and 124 (FIGS. 6 and 7) move due to the thermal expansion of the third and fourth holder units 133 and 134 installed at the first and second elastic members 123 and 124 is away from the fluorescent film 61*a* (FIG. 5) so that the end portions of the first and second support members 121 and 122 (FIGS. 6 and 7) are pulled away from the fluorescent film 61*a* (FIG. 5) of the panel 62. Since the third and fourth holders 133*a* and 134*a* (FIGS. 6 and 7) of the third and fourth holder units 133 and 134 are formed of a material having a thermal expansion coefficient less than that of the first and second holders 131*a* and 132*a* of the first and second holder units 131 and 132, thermal expansion is restricted so that a displacement by pulling in a direction in which the end portions of the first and second support members 121 and 122 are separated away from the panel 62 (FIG. 5) can be minimized. Thus, a difference in the amount of compensation between a middle portion and a side portion of the first and second support members 121 and 122 (FIGS. 6 and 7) can be reduced. Further, the movement of a position slot (to a position E of FIG. 8) due to thermal expansion to a position set at the corner portion of the tension mask 110 (FIGS. 6 and 7) supported by the first and second support members 121 and 122 can be compensated so that color purity of an image can be improved.

Meanwhile, in the preferred embodiment in which the bars 141 and 142 are installed at the end portion of the first and second support members 121 and 122, as shown in FIG. 7, the amount of compensation is increased by the flatness of the first and second support members 121 and 122 according to the expansion of the frame 120. Since the thermal expansion coefficient of the third and fourth holders 133*a* and 134*b* (FIG. 6) of the third and fourth holder units 133 and 134 (FIG. 7) is small, the final compensation amount (a position D of FIG. 8) according to the thermal expansion of the frame and mask is relatively greater.

The above-described operation will be more apparent by the following experiments.

Experiment 1

In the present experiment, 32 inch color cathode ray tubes adopting the tension mask frame assembly according to the present invention are tested. SUS 304H is used for the first and second holders 131*a* and 132*a* of the first and second hook members 131 and 132 installed at the first and second support members 121 and 122 constituting the tension mask frame assembly 100 and SUS 420J2 is used for the first and second springs 131*b* and 132*b*. The holders 133*a* and 134*a* of the third and fourth holder units 133 and 134 installed at the first and second elastic members 123 and 124 are tested, and Table 1 is obtained therefrom. The Table 1 shows results of tests when holders 133*a* and 134*a* are both composed of INVAR, and when holders 133*a* and 134*a* are both composed of SUS.

In Table 1, the "reference" indicates the position of a horizontal end on a central line of a mask, and the "diagonal" indicates an average at the four corners of the mask. The term "horizontal end" indicates one of the ends of a central horizontal line which is coplanar with, and passes through, the center of a mask. As shown in FIG. 6, the central horizontal line (no reference numeral) runs through the center of the tension mask 110. The "peak value" and the "stable amount" indicate the maximum change amount of the beam movement amount within the initial 30 minutes and a change in temperature by the operation until after 3 hours elapse, and of the beam movement amount in the state where the beam movement amount according to the change in temperature is stable. The "delta" indicates a width of the total movement amount until a stable state in a low current state.

As can be seen from Table 1, when the third and fourth holders 133*a* and 134*a* welded to the short side portions, that is, the first and second elastic members 123 and 124, are formed of INVAR steel, the amount of deviation of landing of the electron beam at the diagonal portion of an image is improved by more than 7 μm in the stable amount, compared to a case in which SUS is used. That is, there is an improvement of more than 7 μm when the 19.5 μm (INVAR) is compared to the 27.3 μm (SUS).

Experiment 2

In the present experiment, 34 inch color cathode ray tubes adopting the tension mask frame assembly according to the present invention are tested. The material of the first and second holders 133*a* and 134*a* constituting the tension mask frame assembly 100 are the same as in the above preferred embodiment. The holders 133*a* and 134*a* of the third and fourth holder units 133 and 134 installed at the first and second elastic members 123 and 124 are tested, and Table 2 is obtained therefrom. The Table 2 shows a comparison of the results of tests when holders 133*a* and 134*a* are both composed of INVAR, are both composed of SUS, and are both composed of bimetal.

TABLE 1

| Material for 3rd and 4th | Peak Value | | Stable Amount | | Delta | | Average of Reference- |
|---|---|---|---|---|---|---|---|
| Holders | Reference | Diagonal | Reference | Diagonal | Reference | Diagonal | Diagonal |
| INVAR | −2 μm | −16.3 μm | 1.5 μm | 19.5 μm | 11.5 μm | 36.3 μm | 13 μm |
| SUS | −6 μm | −15.5 μm | 9 μm | 27.3 μm | 15.5 μm | 42.8 μm | 24 μm |

TABLE 2

| Material for 3rd and 4th | Peak Value | | Stable Amount | | Delta | | Average of Reference- |
|---|---|---|---|---|---|---|---|
| Holders | Reference | Diagonal | Reference | Diagonal | Reference | Diagonal | Diagonal |
| INVAR | 18 μm | −16.3 μm | 1.5 μm | 19.5 μm | 11.5 μm | 36.3 μm | 13 μm |
| SUS | 30 μm | −11 μm | 30 μm | 46 μm | 0 μm | 57 μm | 16 μm |
| Bimetal | 18 μm | −14 μm | −11 μm | 10 μm | 11 29 μm | 24 μm | 21 μm |

As can be seen from Table 2, when the third and fourth holders 133*a* and 134*a* welded to the short side portions, that is, the first and second elastic members 123 and 124, are formed of INVAR steel, the amount of deviation of landing of the electron beam at the corner portion of an image is improved by more than 20 μm, compared to a case in which SUS is used. That is, there is an improvement of more than 20 μm when the 19.5 μm (INVAR) is compared to the 46 82 m (SUS). Also, when the third and fourth holders 133*a* and 134*a* of INVAR steel are used, it can be said that the average of (Reference-Diagonal) is reduced, and a landing feature of the electron beam in the areas of low and high temperatures is improved.

As described above, in the tension mask frame assembly of a color cathode ray tube according to the present invention, since a material having a thermal expansion coefficient less than the first and second elastic members is used for the holder units installed at the first and second elastic members, the amount of mislanding of the electron beam at the corner portion of the fluorescent film can be corrected. Furthermore, color purity of an image formed as the fluorescent film is excited by the electron beam can be improved.

The foregoing paragraphs describe the details of the present invention as it relates to a color cathode ray tube (CRT), and more particularly to a tension mask frame assembly having an improved thermal compensation feature to compensate for mislanding of an electron beam due to thermal deformation of a mask to which tension is applied and a frame supporting the mask, and a color cathode ray tube.

While the present invention has been illustrated by the description of embodiments thereof, and while the embodiments have been described in considerable detail, it is not the intention of the inventor to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit and scope of the general inventive concept.

What is claimed is:

1. A tension mask frame assembly for a color cathode ray tube, the assembly comprising a frame and a tension mask;

wherein said frame comprises:

first and second support members separated by a predetermined distance;

first and second elastic members installed between said first and second support members for supporting said first and second support members, said elastic members comprising a first material having a first thermal expansion coefficient;

first and second securing units, said first securing unit being installed on said first support member and including a first holder and a first spring fixed to said first holder, said second securing unit being installed on said second support member and including a second holder and a second spring fixed to said second holder; and third and fourth securing units, said third securing unit being installed on said first elastic member and including a third holder and a third spring fixed to said third holder, said fourth securing unit being installed on said second elastic member and including a fourth holder and a fourth spring fixed to said fourth holder, said third and fourth holders comprising a second material having a second thermal expansion coefficient, the second thermal expansion coefficient being selected from a coefficient that is less than the first thermal expansion coefficient and a coefficient that is equal to the first thermal expansion coefficient;

wherein said tension mask is installed to apply tension to said support members, said tension mask forming a plurality of electron beam passing holes; and wherein said first and second holders comprise a third material having a third thermal expansion coefficient, the second thermal expansion coefficient being less than the third thermal expansion coefficient.

2. The assembly of claim 1, wherein the second material comprises at least one selected from a nickel-iron alloy, thermally refined steel, and a nickel-iron-cobalt alloy.

3. The assembly of claim 2, wherein the nickel-iron alloy contains nickel in a range of 35% through 42% nickel.

4. The assembly of claim 1, said first and second support members and said first and second elastic members comprising thermally refined steel.

5. A tension mask frame assembly for a color cathode ray tube, the assembly comprising a frame and a tension mask;

wherein said frame comprises:

first and second support members separated by a predetermined distance;

first and second elastic members installed between said first and second support members for supporting said first and second support members, said elastic members comprising a first material having a first thermal expansion coefficient;

first and second securing units, said first securing unit being installed on said first support member and including a first holder and a first spring fixed to said first holder, said second securing unit being installed on said second support member and including a second holder and a second spring fixed to said second holder; and third and fourth securing units, said third securing unit being installed on said first elastic member and including a third holder and a third spring fixed to said third holder, said fourth securing unit being installed on said second elastic member and including a fourth holder and a fourth spring fixed to said fourth holder, said third and fourth holders comprising a second material having a second thermal expansion coefficient, the second thermal expansion coefficient being selected from a coefficient that is less than the first thermal expansion coefficient and a coefficient that is equal to the first thermal expansion coefficient;

wherein said tension mask is installed to apply tension to said support members, said tension mask forming a plurality of electron beam passing holes; and said frame further comprising bars connecting said first and second support members, said bars comprising a third material having a third thermal expansion coefficient, the third thermal expansion coefficient being less than the first thermal expansion coefficient.

6. The assembly of claim 5, wherein the second material comprises at least one selected from a nickel-iron alloy, thermally refined steel, and a nickel-iron-cobalt alloy.

7. The assembly of claim 5, wherein the nickel-iron alloy contains nickel in a range of 35% through 42% nickel.

8. A tension mask apparatus, comprising:

first and second support members;

an elastic member installed between said first and second support members for supporting said first and second support members, said elastic member comprising a first material having a first thermal expansion coefficient;

a first securing unit installed on said elastic member, said first securing unit including a first holder and a first spring fixed to said first holder, said first holder comprising a second material having a second thermal expansion coefficient, the second thermal expansion coefficient being selected from a coefficient that is less than the first thermal expansion coefficient and a coefficient that is equal to the first thermal expansion coefficient;

a tension mask installed to apply tension to said support members, said tension mask forming a plurality of electron beam passing holes; and a second securing unit installed on one support member selected from among said first and second support members, said second securing unit including a second holder and a second spring fixed to said second holder, said second holder comprising a third material having a third thermal expansion coefficient, the second thermal expansion coefficient being less than the third thermal expansion coefficient.

9. The apparatus of claim 8, the second material comprising at least one selected from a nickel-iron alloy, thermally refined steel, and a nickel-iron-cobalt alloy.

10. The apparatus of claim 9, wherein the nickel-iron alloy contains nickel in a range of 35% through 42% nickel.

11. The apparatus of claim 8, said first and second support members and said elastic member comprising thermally refined steel.

12. A tension mask apparatus comprising:

first and second support members;

an elastic member installed between said first and second support members for supporting said first and second support members, said elastic member comprising a first material having a first thermal expansion coefficient;

a first securing unit installed on said elastic member, said first securing unit including a first holder and a first spring fixed to said first holder, said first holder comprising a second material having a second thermal expansion coefficient, the second thermal expansion coefficient being selected from a coefficient that is less than the first thermal expansion coefficient and a coefficient that is equal to the first thermal expansion coefficient;

a tension mask installed to apply tension to said support members, said tension mask forming a plurality of electron beam passing holes; and bars connecting said first and second support members, said bars comprising a third material having a third thermal expansion coefficient, the third thermal expansion coefficient being less than the first thermal expansion coefficient.

13. The apparatus of claim 12, wherein the second material includes at least one selected from a nickel-iron alloy, thermally refined steel, and a nickel-iron-cobalt alloy.

14. The apparatus of claim 13, wherein the nickel-iron alloy contains nickel in a range of 35% through 42% nickel.

15. A tension mask apparatus, comprising:

a first member;

a second member connected to said first member for supporting said first member, said second member comprising a first material having a first thermal expansion coefficient;

a first securing unit installed on said second member, said first securing unit including a first holder and a first spring fixed to said first holder, said first holder comprising a second material having a second thermal expansion coefficient, the second thermal expansion coefficient being selected from a coefficient that is less than the first thermal expansion coefficient and a coefficient that is equal to the first thermal expansion coefficient;

a tension mask installed to apply tension to said first member, said tension mask forming a plurality of electron beam passing holes; and a second securing unit installed on said first member, said second securing unit including a second holder and a second spring fixed to said second holder, said second holder comprising a third material having a third thermal expansion coefficient, the second thermal expansion coefficient being less than the third thermal expansion coefficient.

16. The apparatus of claim 15, wherein the second material comprises at least one selected from a nickel-iron alloy, thermally refined steel, and a nickel-iron-cobalt alloy, wherein the nickel-iron alloy contains nickel in a range of 35% through 42% nickel, and wherein said first and second members comprise thermally refined steel.

17. The apparatus of claim 16, further comprising at least one bar connected to said first member, said bar comprising a fourth material having a fourth thermal expansion coefficient, the fourth thermal expansion coefficient being less than the first thermal expansion coefficient.

18. A tension mask apparatus, comprising:

a first member;

a second member connected to said first member for supporting said first member, said second member comprising a first material having a first thermal expansion coefficient;

a first securing unit installed on said second member, said first securing unit including a first holder and a first spring fixed to said first holder, said first holder comprising a second material having a second thermal expansion coefficient, the second thermal expansion coefficient being equal to the first thermal expansion coefficient;

a tension mask installed to apply tension to said first member, said tension mask forming a plurality of electron beam passing holes; and at least one bar connected to said first member, said bar comprising a third material having a third thermal expansion coefficient, the third thermal expansion coefficient being less than the first thermal expansion coefficient.

19. The apparatus of claim 18, further comprising a second securing unit installed on said first member, said second securing unit including a second holder and a second spring fixed to said second holder, said second holder comprising a third material having a third thermal expansion coefficient, the second thermal expansion coefficient being less than the third thermal expansion coefficient.

20. The apparatus of claim 18, wherein the second material comprises at least one selected from a nickel-iron alloy, thermally refined steel, and a nickel-iron-cobalt alloy, wherein the nickel-iron alloy contains nickel in a range of 35% through 42% nickel, and wherein said first and second members comprise thermally refined steel.

21. The apparatus of claim 18, further comprising an elastic member installed between said first and second members for supporting said first and second members, said elastic member comprising a fourth material having a fourth thermal expansion coefficient.

22. The apparatus of claim 18, further comprising first and second elastic members installed between said first and second members for supporting said first and second members, said elastic members comprising a fourth material having a fourth thermal expansion coefficient.

23. The apparatus of claim 22, further comprising third and fourth securing units, said third securing unit being installed on said first elastic member and including a third holder and a third spring fixed to said third holder, said fourth securing unit being installed on said second elastic member and including a fourth holder and a fourth spring fixed to said fourth holder, said third and fourth holders comprising a fifth material having a fifth thermal expansion coefficient, the fifth thermal expansion coefficient being selected from a coefficient that is less than the first thermal expansion coefficient and a coefficient that is equal to the first thermal expansion coefficient.

24. A tension mask apparatus comprising:

a first member;

a second member connected to said first member for supporting said first member, said second member comprising a first material having a first thermal expansion coefficient;

a first securing unit installed on said second member, said first securing unit including a first holder and a first spring fixed to said first holder, said first holder comprising a second material having a second thermal expansion coefficient, the second thermal expansion coefficient being equal to the first thermal expansion coefficient;

a tension mask installed to apply tension to said first member, said tension mask forming a plurality of electron beam passing holes; and a second securing unit installed on one member selected from among said first and second members, said second securing unit including a second holder and a second spring fixed to said second holder, said second holder comprising a third material having a third thermal expansion coefficient, the second thermal expansion coefficient being less than the third thermal expansion coefficient.

* * * * *